United States Patent [19]

Kostylev et al.

[11] Patent Number: 4,683,960

[45] Date of Patent: Aug. 4, 1987

[54] AIR-OPERATED REVERSIBLE PERCUSSIVE ACTION MACHINE

[76] Inventors: Alexandr D. Kostylev, ulitsa Derzhavina, 19, kv. 70, Novosibirsk; Vasily I. Ivinsky, ulitsa Tsnyanskaya, 2, korpus 3, kv. 19, Minsk; Alexandr D. Filonov, ulitsa Zhudro, 81, kv. 21, Minsk; Vladimir V. Klimashko, ulitsa Frunze, 67, kv. 124, Novosibirsk, all of U.S.S.R.

[21] Appl. No.: 659,779

[22] Filed: Oct. 11, 1984

[51] Int. Cl.[4] ..... B25D 9/00

[52] U.S. Cl. ..... 173/91; 173/134

[58] Field of Search ..... 173/91, 134, 135; 91/234

[56] References Cited

U.S. PATENT DOCUMENTS 3,744,576 7/1973 Sudnishnikov ..... 173/91

FOREIGN PATENT DOCUMENTS 1634417 2/1971 Fed. Rep. of Germany .
2105229 8/1972 Fed. Rep. of Germany .
2722298 4/1978 Fed. Rep. of Germany .
2735062 8/1979 Fed. Rep. of Germany ..... 173/91
2425506 12/1979 France .
981519 8/1980 U.S.S.R. ..... 173/91

*Primary Examiner*—E. R. Kazenske
*Assistant Examiner*—Willmon Fridie, Jr.
*Attorney, Agent, or Firm*—Lilling & Greenspan

[57] ABSTRACT

An air-operated reversible percussive action machine comprises a housing in which there is disposed for axial reciprocations a hammer, defining therewith a front working chamber and having a through radial passage. In the axial interior of the hammer on the side of its tail end there is provided a cylindrical stepped tube including coaxially arranged first and second steps of large and small diameters, respectively, these steps having through radial passages. The first step of the tube defines with the hammer a rear working chamber, and with the second step defines an annular cavity in which a spring sleeve capable of axial displacements is disposed. The outer diameter of the sleeve is substantially less than the inner diameter of the first step of the tube to form an annular passage there between. The machine is further provided with a means for pressure-sealing the annular cavity and a means for controlling the displacements of the sleeve.

2 Claims, 3 Drawing Figures

AIR-OPERATED REVERSIBLE PERCUSSIVE ACTION MACHINE

FIELD OF THE INVENTION

This invention relates generally to civil engineering and road construction machinery, and more particularly to air-operated reversible percussive action machines.

The invention can find most advantageous application in machines for making holes in the ground, or in machines for driving into the ground steel tubes used as casings for underground communications.

Other possible applications of the proposed air-operated reversible percussive action machine include driving tubular piles into the ground, deep-hole soil compacting, and forcing small piles directly in the ground.

BACKGROUND OF THE INVENTION

Recently wide use has been found for air-operated reversible percussive action machines, as the provision for reversal is necessary for retracting the machine from holes or for disconnecting the machine from a tube subsequent to driving it into the ground.

An ever increasing application of air-operated reversible percussive action machines requires improvements in their reliability. During the driving of horizontal holes in of lengths over 15–20 meters, or during the driving of vertical holes (such as for deep-hole soil compacting, pressing concrete piles in the ground, etc.) when retracting the machine from such holes is complicated, the mechanism for reversing the percussive action must be especially reliable.

Of no less importance is to the simplification of the device structurally to improve its reliability, make it less complicated and less expensive in fabrication, as well as to ensure a more prompt switchover of the machine to a rearward percussive action.

There is known a device (cf., West German Pat. No. 1,634,417) which includes a substantially hollow cylindrical housing, a hammer accommodated inside the housing for axial reciprocations and delivering impacts on the housing by its front or rear portion, and a stepped tube threadingly connected to the housing through a flange element.

In order to reverse the percussive action of such a device, it is necessary to displace the stepped tube to a new position toward the tail end of the housing by rotating an air supply hose fixedly attached to the stepped tube.

Inherent in the above device is its insufficient reliability because reversal of the percussion action is complicated or even impossible when driving vertical or elongated horizontal holes.

Also, the reversal of the percussive action of the above device requires a number of time-consuming operations affecting its efficiency, these operations including termination of the supply of compressed air, disconnection of the air hose from the compression, and pulling the hose prior to rotating it.

There is also known another percussive action machine (cf., West German Pat. No. 2,340,751) which comprises a hollow cylindrical housing, a hammer reciprocating inside the housing and intended to deliver impacts on the housing by its front or rear portion, and a tube of stepped configuration rigidly secured in grooves of the tail end of the housing through a locking means and connected to the hammer.

For reversing the percussive action of the aforementioned machine use is made, apart from a hose, of a flexible steel cable. By pulling the cable the action of the locking means is eliminated, and the stepped tube is moved to a new position, that is reversal is made possible by a simple linear motion of the stepped tube instead of the rotational movement.

However, the hose must also be turned to bring the stepped tube out of engagement with the grooves and put it in registration with other grooves in its rearmost position. In consequence, the device described in West German Pat. No. 2,340,751 suffers from essentially the same disadvantages as those described heretofore.

There is further known a percussive action machine (cf., West German Pat. No. 2,105,229) which differs from the aforedescribed ones only by the construction of the stepped tube, the latter including an outer step having through radial passages and an inner step with similar through radial passages, the tube being secured coaxially with the housing to be capable of turning and displacing axially relative to the outer step.

A switchover to the reverse percussive action is done here by turning the inner step of the tube relative to the outer step by a multiple supply of compressed air to the machine.

This device offers some advantage over those already described in that is no need for rotating the hose.

However, the machine is disadvantageous in that the multiple delivery of compressed air may bring some uncertainty as to whether the operator is aware of the machine function subsequent to every successive delivery of compressed air, or whether the machine will operate at all, since intermediate positions are possible apart from the forward and rearward percussive actions. Another disadvantage lies in the fact that the machine is structurally overcomplicated and therefore difficult to manufacture.

A device which bears the closest resemblance to one to be proposed in the description that will follow is an air-operated reversible percussive action machine as taught in West German Pat. No. 2,722,298. This machine comprises a housing, a hammer axially and reciprocably disposed inside the housing and having in its tail portion an axial cavity open on one end, and a through radial passage. The hammer and the housing define a front working chamber. A stepped tube also accommodated inside the housing includes substantially cylindrical steps of relatively larger and smaller diameters, with radial passages provided therein.

The larger diameter step is disposed in said axial cavity of the hammer to define a rear working chamber, whereas the step of smaller diameter is secured by a flange in the tail portion of the housing. Installed with precision inside the stepped tube is a spring-loaded sleeve. An air supply hose functions as a means for controlling the axial displacement of the spring-loaded sleeve. the forward percussive action of the machine is initiated when the sleeve assumes the front most of the percussion action is position; reversal accomplished by moving the sleeve to the extreme rear position.

In general, this device obviates the disadvantages inherent in the heretofore described constructions of the prior art percussive action machines, since reversal is achieved by merely applying tension to the hose, and the elements of the machine are at any time in a position to execute either the forward of the rearward actions.

However, even this device is not without some drawbacks. For example, the sliding action and pressure-sealing of the sleeve on two of its cylindrical surfaces requires precise fabrication of the mating surfaces and thus the machine is rather difficult to manufacture. It also lacks reliability because sliding of the sleeve along its two cylindrical surfaces may result in jamming, especially when dirt adheres to such surfaces.

Also, the machine has a pressure-sealed interior consisting of three isolated sections defined by the spring-loaded sleeve and the stepped tube. This interior is likewise made hermetic because of the precision of the sliding surfaces.

SUMMARY OF THE INVENTION

It is an object of this invention to improve the reliability of reversing the percussive action of the machine.

Another object is to provide an air-operated reversible percussive action machine which would be easier to manufacture.

One more object of the invention is to structurally simplify the machine.

These and other objects and attending advantages are attained in an air-operated reversible percussive action machine comprising a housing, a hammer disposed for reciprocations inside the housing and having in its tail portion an axial cavity open on the end thereof, and a through radial passage defining a front working chamber with the housing and, a cylindrical tube of stepped configuration which includes first and second cylindrical steps of relatively larger and smaller diameters, respectively, having through radial passages. The first step of the tube is arranged in the cavity of the hammer to form a rear working chamber, and the second step of the tube is rigidly attached in the tail end of the housing by means of a flange. Further, a spring-loaded sleeve is installed inside the stepped tube for axial displacements therein and is provided with a means for controlling such displacements, this sleeve forms with the tube an annular cavity, a means for pressure-sealing this cavity is provided which is, characterized in that the first and second steps of the tube are arranged coaxially and the spring-loaded sleeve is disposed on the second step of the tube inside its first step, the outer diameter of this sleeve being substantially less than the inner diameter of the first step of the tube to define an annular passage therebetween.

The proposed construction of the machine obviates sliding of the sleeve on the first cylindrical step of the tube, which prevents its jamming during displacement. Such a construction does not require precision during the finishing of the outer surface of the sleeve and the surface of the first step of larger diameter embracing the sleeve.

This in turn considerably simplifies the machine structurally and makes it easier to fabricate. The provision of the annular passage between the sleeve and the first step of the tube prevents jamming of the sleeve during its displacements, which improves the overall reliability of the machine.

Other objects and attending advantages will become more fully apparent from a more detailed description of various preferred embodiments.

DETAILED DESCRIPTION OF THE INVENTION

Figure 1:
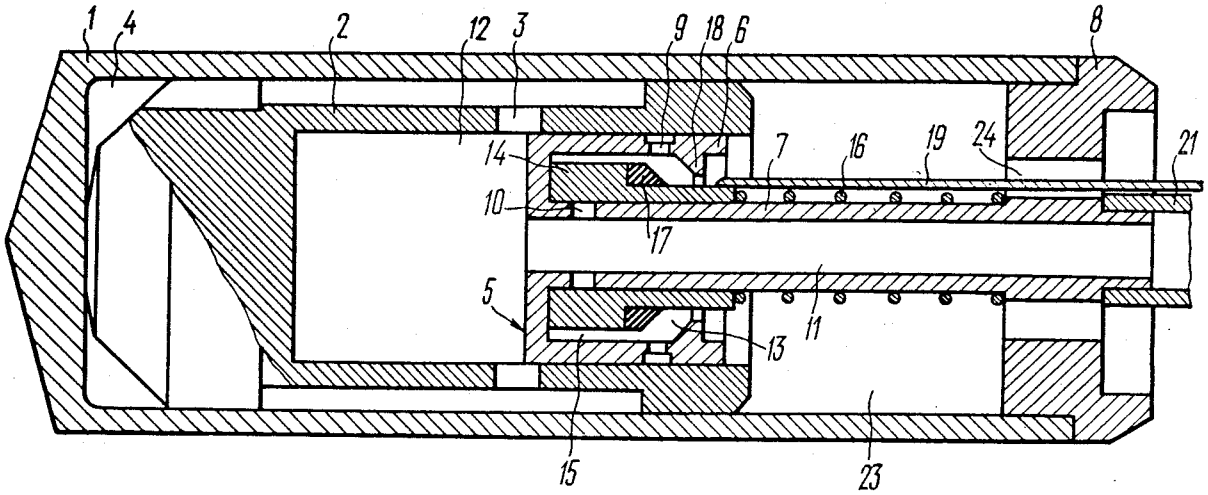
FIG. 1 is a longitudinal sectional view illustrating the elements of the reversible percussive action machine in a forward percussive action position.

An air-operated reversible percussive action machine comprises a housing 1 and a hammer 2 accommodated for reciprocations inside the housing 1. In its tail end the hammer 2 has an axial cavity and a through passage 3. The hammer 2 defines with the housing 1 a front working chamber 4.

The housing 1 also accommodates a substantially cylindrical tube 5 of stepped configuration having two cylindrical steps 6 and 7 of large and small diameter, respectively; these steps being arranged coaxially one relative to the other. The tube 5 is rigidly secured on the tail portion of the housing 1 by means of a flange 8 affixed to the step 7. The step 6 has a through radial passage 9, whereas the step 7 has a through radial passage 10 and an axial passage 11. The step 6 is disposed inside the axial cavity of the hammer 2 to define therewith a rear working chamber 12. Disposed between the steps 6 and 7 of the tube 5 is an annular cavity 13 in which on the step 7 there is arranged for axial reciprocations a cylindrical sleeve 14 having an outer diameter substantially less than the inner diameter of the step 6 for preventing contact between the sleeve 14 and the inner cylindrical surface of the step 6. Interposed between the sleeve 14 and the step 6 is an annular passage 15. Mounted on the step 7 of the tube 5 is a spring 16 one end of which bears on the flange 8 and the other end on the end face of the sleeve 14. A means for pressure—sealing the cavity 13 is provided in the form of an elastic sealing element 17 arranged on the end face of the sleeve 14, and a seat 18 in the inner portion of the step 6. The displacements of the sleeve 14 is controlled by a steel cable 19 (FIGS. 1 and 2), or by a tube 20 (FIG. 3), one end of which is connected to an air delivery hose 21, whereas the other end is connected to the sleeve 14 by means of a pin 22 secured in the passage 10 and capable of axial displacement relative to the step 7.

Provided between the flange 8 and the hammer 2 in the housing 1 is an interior 23 communicable via holes 24 made in the flange 8 with the atmosphere.

The proposed machine operates in the following manner.

(a) The forward percussive action of the machine.

Normal position of the sleeve 14, that is extreme relative to the head end of the device, is maintained by the spring 16 (FIG. 1). This position of the sleeve 14 corresponds to the forward percussive action of the machine. The initial position of the hammer in the housing 1 may be arbitrary. The cable 19 is free of tension. Prior to operation the machine is connected to a compressor (not shown). By using the hose 21, the machine is orientated in a required direction and pressed against the soil to be driven into by the forward, somewhat sharpened, portion by using a special starting device or by a simple lever.

Thereafter, the compressor outlet valve is opened for the compressed air to flow along the hose 21, and axial passage 11 of the tube 5 to the rear working chamber 12. The compressed air acts to shift the hammer 2 until it stops against the end face of the head portion of the housing 1 and open the radial passage 3 of the hammer 2 as shown in FIG. 1. The compressed air then enters the front working chamber 4. Because of the working surface area of the hammer 2 on the side of the chamber 4 is greater on the side of the chamber 12 then at equal pressures in the two chambers 4 and 12, a force applied to the hammer 2 on the side of the chamber 4 is greater than the force acting on the side of the chamber 12. Under the action of the resultant force the hammer 2 is caused to move toward the flange 8 (to the right—hand side as shown in FIG. 1).

Subsequent to blocking the radial passage 3 by the cylindrical step 6, that is, after terminating the delivery of compressed air to the chamber 4, the hammer 2 continues travelling under the action of the pressure of expanding air in the chamber 4. Upon registration of the radial passage 3 of the hammer 2 with the radial passage 9 of the step 6, the air is conveyed from the chamber 4 through the passages 3 and 9 to the cavity 13, and thereafter to the interior 23 to escape through the holes 24 of the flange 8 to the atmosphere.

Because there is no pressure in the chamber 4, while the chamber 12 is continuously exposed to the pressure of compressed air, the hammer 2 travels toward the head end of the housing 1 (to the left-hand side as shown in FIG. 1) to deliver an impact on its inner end face.

At the moment of the impact the chamber 4 is filled with compressed air in the manner described heretofore, and the cycle is recommenced. The action of impacts on the housing 1 makes the machine to penetrate the ground (when making a hole), or to drive into the ground a steel pipe for which purpose the machine is connected coaxially to this pipe.

(b) The rearward action of the machine.

Such a reversal is normally needed to return the machine from the hole previously made thereby.

Figure 2:
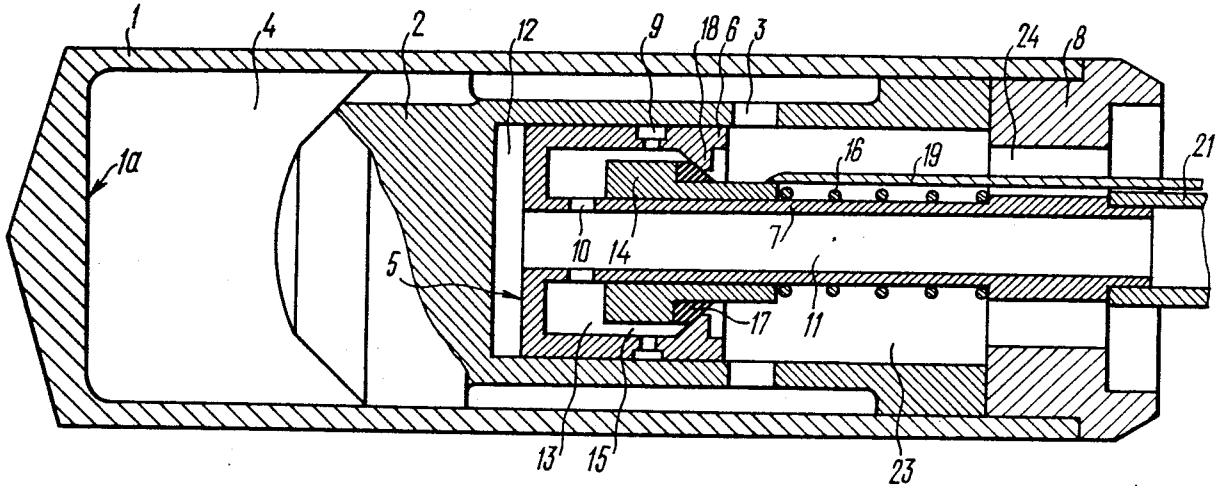
FIG. 2 is a longitudinal sectional view illustrating the elements of the reversible percussive action machine in a reverse percussive action position.
Figure 3:
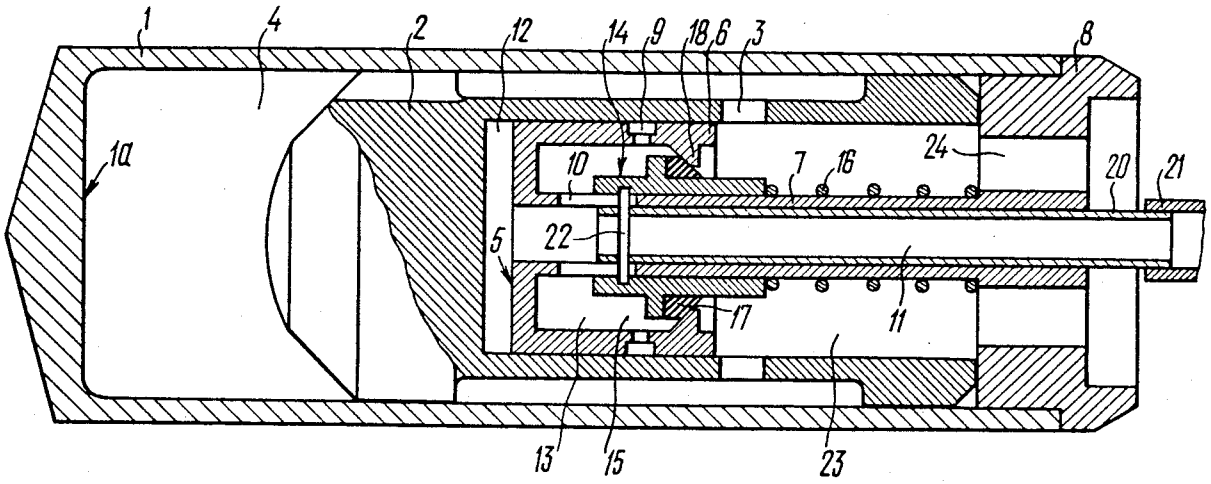
FIG. 3 is a longitudinal sectional view of an alternate embodiment of the reversible percussive action machine.

In order to switch the machine over to a rearward percussive action, it is necessary, without terminating the supply of compressed air, to apply a tension force to the cable 19 (FIGS. 1 and 2) and, by overcoming the compression force of the spring 16, to move the sleeve 14 to its rearmost position; in other words, to move it from the position shown in FIG. 1 to the position illustrated in FIG. 2.

In this latter position the elastic sealing element 17 is brought into intimate contact with the seat 18 to thereby pressure-seal the annular cavity 13. This causes the radial passage 10 of the cylindrical step 7 to open and change the functions of the radial passage 9 of the step 6 and annular cavity 13; particularly, they are disconnected from the system of discharge passages to be brought into engagement with the system of passages supplying compressed air to the working chamber 4.

In the mutual position of the elements of the proposed machine illustrated in FIG. 2 compressed from the compressor is conveyed along the hose 21 and the axial passage 11 to the rear working chamber 12, and through the radial passage 10 to the annular cavity 13. The pressure of compressed air in the annular cavity 13 acts to press the sleeve 14 with the sealing element 17 against the seat 18 of the step 7 to be held in this position thus overcoming the compression force of the spring 16.

Under the action of the pressure of compressed air in the chamber 12 the hammer 2 initiates its travel toward the end face of the head end of the housing 1. When the radial passage 3 of the hammer 2 is brought in registration with the radial passage 9 of the step 6, compressed air is caused to flow from the annular cavity 13 to the chamber 4. This decelerates the movement of the hammer 2 and makes it stop at a certain distance from the flange 8 of the housing 1.

When the chamber 4 is filled with compressed air, the hammer 2 travels toward the flange 8 to deliver an impact thereon. At the moment of the impact compressed air is caused to flow from the chamber 4 through the radial passage 3 of the hammer 2 to enter the interior 23, as seen best in FIG. 2, and to thereafter escape to the atmosphere through the holes 24 of the flange 8.

Subsequent to delivering an impact on the flange 8, the hammer 2 is acted upon by the pressure of air in the chamber 12 to start its travel toward the head end of the housing 1 for the cycle to be recommenced in the aforedescribed fashion.

Reliable reversal of the percussive action of the proposed machine is ensured when the following conditions are complied with:

(1) $P_1 > P_r$;

(2) $P_a > P_2 + P_r$, where $P_1$ is the preliminary compression force of the spring 16;

$P_2$ is the final compression force of the spring 16;

$P_r$ is the force resistance (friction) to the movement of the hose 21 during the forward percussive action of the machine (FIG. 3); and $P_a$ is the force produced by the pressure of compressed air in the annular cavity 13 acting to force the sleeve 14 toward the seat 18.

A switchover of the action of the proposed machine to reverse may be done both prior to starting and during operation in the forward percussive action mode without terminating the supply of compressed air to the machine.

During rearward percussive action of the machine the annular cavity 13 is continuously under the pressure of compressed air, which guarantees continuous blocking of the annular cavity 13 by the sleeve 14 and, consequently, a stable position of the sleeve 14 in engagement with the seat 18.

Opening of the annular cavity 13, i.e. communication with the atmosphere, is possible only when the supply of compressed air is terminated, which allows to displace the sleeve 14 to a position shown in FIG. 1 by means of the spring 16.

What we claim is:

1. An air-operated reversible percussive action machine comprising:

a housing;

a hammer accommodated inside said housing and capable of axial reciprocations, said hammer striking blows on a front inner end of said housing when operating in a forward percussive action operational mode and striking blows on a tail inner end of said housing when operating in a rearward percussive action operational mode, and said hammer having an axial cavity open on a first end facing said tail inner end of said housing and a through radial passage facing said tail inner end, said hammer defining with said housing a front working chamber near said front inner end of said housing;

a cylindrical tube coaxially accommodated in said housing near said hammer and having a stepped configuration wherein a first step has a larger diameter than a second step, said first step having a through radial passage and located within said axial cavity of said hammer in a manner forming a rear working chamber with said hammer and said second step having a through radial opening within said annular cavity and said radial opening being in an opened position when the machine is operated in said rearward percussive action mode and being in a closed position when the machine is operated in said forward percussive action mode, said first and second steps of said cylindrical tube forming an annular cavity between them;

a spring-loaded cylindrical sleeve mounted on said second step of said cylindrical tube in said annular cavity and being movable for axial reciprocations;

a means for pressure-sealing said annular cavity;

a means for controlling displacements of spring-loaded cylindrical sleeve; and a flange mounted on said second step of said cylindrical tube and connecting said cylindrical tube to said tail end in said housing.

2. An air-operated reversible percussive action machine according to claim 1, wherein said means for controlling said displacements of said spring loaded sleeve comprises a tube disposed inside said second step of said cylindrical stepped tube; and a pin connecting said spring loaded sleeve to said cylindrical stepped tube, said pin located in said through radial opening of said second step of said cylindrical tube and axially moveable within the percussive action machine.

* * * * *